US009856441B2

(12) United States Patent
Gu et al.

(10) Patent No.: US 9,856,441 B2
(45) Date of Patent: Jan. 2, 2018

(54) SOAP BAR

(71) Applicant: COLGATE-PALMOLIVE COMPANY, New York, NY (US)

(72) Inventors: Ben Gu, East Brunswick, NJ (US); Janine Chupa, Princeton, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 15/103,205

(22) PCT Filed: Dec. 10, 2013

(86) PCT No.: PCT/US2013/074004
§ 371 (c)(1),
(2) Date: Jun. 9, 2016

(87) PCT Pub. No.: WO2015/088489
PCT Pub. Date: Jun. 18, 2015

(65) Prior Publication Data

US 2016/0312161 A1 Oct. 27, 2016

(51) Int. Cl.

| | |
|---|---|
| ***C11D 9/32*** | (2006.01) |
| ***C11D 17/00*** | (2006.01) |
| ***C11D 13/10*** | (2006.01) |

(52) U.S. Cl.
CPC ..... *C11D 9/32* (2013.01); *C11D 13/10* (2013.01); *C11D 17/006* (2013.01); *C11D 17/0047* (2013.01)

(58) Field of Classification Search
None
See application file for complete search history.

(56) References Cited

U.S. PATENT DOCUMENTS 6,344,435 B1 * 2/2002 Miyahara ..... C07C 309/14 510/494
2015/0322388 A1 11/2015 Pan et al.

FOREIGN PATENT DOCUMENTS

| | | |
|---|---|---|
| EP | 1057888 | 12/2000 |
| JP | 2001172692 | 6/2001 |
| JP | 2001200294 | 7/2001 |
| WO | WO2011079163 | 6/2011 |
| WO | WO2013131708 | 9/2013 |

OTHER PUBLICATIONS

Corresponding International Search Report for PCT/US2013/074004 dated Aug. 27, 2014.

* cited by examiner

*Primary Examiner* — Necholus Ogden, Jr.

(57) ABSTRACT

Provided herein is a method for reducing or inhibiting the crystallization of taurine in a soap bar, wherein the method comprises: a) admixing a fatty acid soap with an aqueous solution of taurine or taurine salt as a taurine source to form an amalgamate and b) preparing a soap bar comprising the amalgamate. Further provided is a soap bar obtained by the above method.

21 Claims, No Drawings

SOAP BAR

CROSS-REFERENCE TO RELATED PATENT APPLICATIONS

The present application is a U.S. national stage application under 35 U.S.C. §371 of PCT Application No. PCT/US2013/074004, filed Dec. 10, 2013, the entirety of which is incorporated herein by reference.

BACKGROUND

Taurine (2-aminoethanesulfonic acid) is an acid containing an amino group, and has the following structural formula:

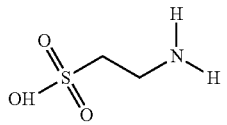

Taurine is readily available in solid form, usually as a powder. However, as described herein, when taurine is incorporated into soap bar precursor formulations (amalgamates) as a solid additive, after manufacturing of the soap bar and on aging of the soap bar, re-crystallization of taurine occurs. Re-crystallization of taurine produces a rough surface which is undesirable for the consumer.

It would therefore be desirable to provide soap bars comprising taurine which are resistant to taurine re-crystallization, and a method of manufacturing soap bars comprising taurine which are resistant to taurine re-crystallization.

BRIEF SUMMARY

The present inventors have found that when taurine is incorporated as a solid additive into an amalgamate for forming a soap bar, there is a tendency for the taurine to recrystallize as the soap bar ages. However, the present inventors have determined that if taurine is incorporated into the amalgamate in the form of a taurine or taurine salt solution, then the soap bar formed from the amalgamate is resistant to taurine recrystallization.

Accordingly, in a first aspect, provided is a method for substantially inhibiting the crystallization of taurine in a soap bar, wherein the method comprises:

admixing a fatty acid soap with an aqueous solution of taurine or taurine salt as a taurine source to form an amalgamate and, preparing a soap bar comprising the amalgamate;

wherein the taurine or taurine salt is represented by Formula 1:

Formula 1

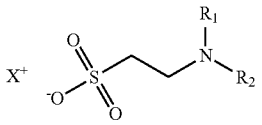

wherein X is a cation selected from an alkali metal cation, ammonium and triethanolammonium, and wherein $R_1$ and $R_2$ are independently selected from H and a $C_1$-$C_4$ alkyl.

In a second aspect, provided is a use of an aqueous solution of taurine or taurine salt as a taurine source in the manufacture of a soap bar for reducing crystallization of taurine in the soap bar, wherein the manufacture of the soap bar comprises a) combining a fatty acid soap with the aqueous solution of taurine or taurine salt to form an amalgamate and, b) preparing a soap bar comprising the amalgamate;

wherein the taurine or taurine salt is represented by Formula 1:

Formula 1

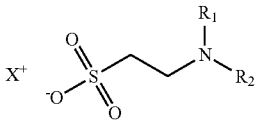

wherein X is a cation selected from an alkali metal, ammonium and triethanolammonium, and wherein $R_1$ and $R_2$ are independently selected from H and a $C_1$-$C_4$ alkyl.

Typically, $R_1$ and $R_2$ are H.

Optionally, X is an alkali metal cation selected from sodium and potassium. Further optionally, the aqueous solution of the taurine or taurine salt is prepared by admixing an alkali metal hydroxide solution, taurine or taurine salt, and water, wherein the alkali metal is selected from sodium and potassium.

Preferably, the soap bar does not comprise any taurine source other than the aqueous solution of the taurine or taurine salt.

Optionally, the aqueous taurine solution comprises taurine salt in an amount of 40 to 60 weight %.

Preferably, the soap bar comprises taurine or taurine salt as defined in Formula 1, in an amount of 0.1 to 5 weight % by total weight of the soap bar. More preferably, the soap bar comprises taurine or taurine in an amount of 1 to 3 weight % by total weight of the soap bar.

Preferably, the soap bar comprises fatty acid soap in an amount of 70 weight % to 90 weight %. More preferably, the soap bar comprises fatty acid soap in an amount of 75 weight % to 80 weight %.

Optionally, the fatty acid soap is admixed with the aqueous solution of taurine or a taurine salt at a temperature of 25° C. to 35° C.

Typically, the fatty acid soap is provided in the form of soap chips. Optionally, the soap chips comprise a least one neutralized fatty acid, sodium chloride and glycerine.

Optionally, in step a), the aqueous solution of the taurine or taurine salt is further admixed with one or more agents selected from structurants, skin conditioning agents, foam boosters, dyes, fragrances, preservatives, chelating agents, antimicrobial agents, and exfoliating/scrubbing particles to form the amalgamate. Preferably, the aqueous solution of the taurine or taurine salt is further admixed with fragrance to form the amalgamate.

Optionally, step b) comprises milling and/or refining of the amalgamate, and extrusion of the milled/refined amalgamate.

Typically, the pH of the soap bar, in solution, is from 7 to 11, optionally 9 to 11.

In a third aspect, provided is a soap bar obtained by a method comprising:

a) admixing a fatty acid soap with an aqueous solution of taurine or taurine salt as a taurine source to form an amalgamate and, b) preparing a soap bar comprising the amalgamate;

wherein the taurine or taurine salt is represented by Formula 1:

Formula 1

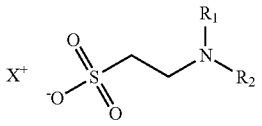

wherein X is a cation selected from hydrogen, an alkali metal, ammonium and triethanolammonium, and wherein $R_1$ and $R_2$ are independently selected from H and a $C_1$-$C_4$ alkyl.

Optionally, the method is as defined herein.

In a fourth aspect, provided is a method for cleansing skin, comprising applying the soap bar as defined herein to skin.

Further areas of applicability of the present invention will become apparent from the detailed description provided hereinafter. It should be understood that the detailed description and specific examples, while indicating the preferred embodiment of the invention, are intended, for purposes of illustration only and are not intended to limit the scope of the invention.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein, and elsewhere in the specification should be understood to refer to percentages by weight. The amounts given are based on the active weight of the material.

In one arrangement, provided is a method for reducing or inhibiting the crystallization of taurine in a soap bar, wherein the method comprises:

admixing a fatty acid soap with an aqueous solution of taurine or taurine salt as a taurine source to form an amalgamate and, preparing a soap bar comprising the amalgamate;

wherein the taurine or taurine salt is represented by Formula 1:

Formula 1

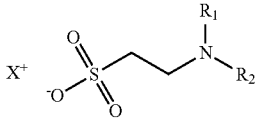

wherein X is a cation selected from hydrogen, an alkali metal cation, ammonium and triethanolammonium, and wherein $R_1$ and $R_2$ are independently selected from H and a $C_1$-$C_4$ alkyl.

In a second arrangement, provided is a use of an aqueous solution of taurine or taurine salt as a taurine source in the manufacture of a soap bar for reducing crystallization of taurine in the soap bar, wherein the manufacture of the soap bar comprises a) combining a fatty acid soap with the aqueous solution of taurine or taurine salt to form an amalgamate and, b) preparing a soap bar comprising the amalgamate;

wherein the taurine or taurine salt is represented by Formula 1:

Formula 1

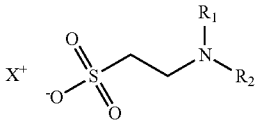

wherein X is a cation selected from hydrogen, an alkali metal, ammonium and triethanolammonium, and wherein $R_1$ and $R_2$ are independently selected from H and a $C_1$-$C_4$ alkyls.

Substituents

In the method and use, typically $R_1$ and $R_2$ are both H (i.e. Formula 1 represents taurine). In other embodiments, one of $R_1$ and $R_2$ is H, and the other is a $C_1$-$C_4$ alkyl, preferably methyl or ethyl, and most preferably, methyl. Di-alkyl taurine derivatives are also envisaged for use such that at least one of $R_1$ and $R_2$ is methyl, and the other is selected from $C_1$-$C_4$ alkyl, preferably methyl.

In a preferred embodiment, X is selected from an alkali metal such as sodium and potassium. Most preferably, X is sodium. Sodium and potassium salts are advantageous due to their high solubility. Ammonium and substituted ammonium cations (e.g. quaternary ammonium ions) may also be used. Triethanolammonium is one example of a quaternary ammonium ion that may be used.

Any cation disclosed herein may be provided in association with any $R_1$ and $R_2$ substituent as defined herein.

If X is sodium or potassium, then the aqueous solution of the taurine or taurine salt may be prepared by admixing sodium or potassium hydroxide solution, taurine or taurine sale and water to provide a sodium or potassium taurine solution.

Typically in the manufacture of soap bars, the required ingredients (including fatty acid soap) are mixed together to form an amalgamate. Subsequently, the amalgamate is cooled and extruded to form the soap bar. Further details of the manufacturing process are provided below. The present inventors have found that during the manufacture of soap bars, when taurine is incorporated into the amalgamate as an aqueous solution of taurine or taurine salt instead of solid taurine, then re-crystallization of taurine in the soap during aging of the bar is inhibited. Using a solution of taurine itself (i.e. not in salt form) also prevents re-crystallization of taurine. However, unlike the taurine salts defined herein, taurine itself has limited solubility of only up to about 6%. Therefore, in order to achieve a final taurine concentration of 2 weight % in the soap bar, about 33 weight % of a 6% taurine solution would have to be incorporated into the amalgamate. This would undesirably increase the amalgamate volume, and it would be necessary to ultimately remove excess solvent, rendering the process very expensive and time consuming. The method overcomes these disadvantages by employing a taurine solution or taurine salt solution as the taurine source.

Given that taurine in the form of a solid additive promotes re-crystallization, in some embodiments, the amalgamate or soap bar does not comprise any taurine source other than the aqueous solution of the taurine or taurine salt. In particular, in a preferred embodiment, the amalgamate does not comprise any taurine provided in the form of a solid additive. However, the aqueous solution of the taurine or taurine salt may comprise a mixture of two, three or more different taurine or taurine salts.

Aqueous Taurine or Taurine Salt Solution

The aqueous taurine or taurine salt solution that is incorporated into the amalgamate may comprise or taurine or taurine sale in an amount of about 40 weight % to about 60 weight %, about 70 weight % or about 80 weight % by total weight of the solution. (The amounts defined in this paragraph refer to the taurine or taurine salt moiety and exclude cation X.) Preferably, the aqueous taurine or taurine salt solution that is incorporated into the amalgamate comprises taurine or taurine salt in amount of from about 45 weight % to about 70 weight % or more preferably, from about 50 weight % to about 65 weight %.

In some embodiments, the final concentration of taurine or taurine salt in the soap bar is from about 1 weight % to about 5 weight % by total weight of the soap bar. Preferably, the final concentration of taurine or taurine salt in the soap bar is from 1 weight % to about 4 weight % or from about 1 weight % to about 3 weight %. In other embodiments, the final concentration of taurine in the soap bar is from about 2 weight % to about 5 weight % or from about 2 weight % to about 4 weight %. (Typically, taurine is present in its anionic form in the soap bar and the amounts defined in this paragraph refer to the anionic taurine or taurine salt moiety, excluding cation X.)

The present inventors have found that if the aqueous taurine or taurine salt solution that is incorporated into the amalgamate has a concentration of taurine or taurine salt as defined herein, then the volume of salt solution that must be incorporated into the amalgamate to achieve a final concentration of taurine or taurine salt in the soap bar as defined herein, is small enough to avoid any further solvent removal/evaporation process.

Fatty Acid Soap

In some embodiments, the aqueous taurine or taurine salt solution is combined with a fatty acid soap.

The term "soap" as used herein may be defined generally as the alkali metal or alkanol ammonium salts of aliphatic alkane- or alkene-monocarboxylic acids, preferably having about 6 to 22 carbon atoms, or about 6 to 18 carbon atoms, or about 12 to 18 carbon atoms.

The fatty acid soap typically comprises a neutralized fatty acid. Typical fatty acids used for soaps include myristic acid, lauric acid, palmitic acid, and stearic acids. Sources of fatty acids include coconut oil, palm oil, palm kernel oil, tallow, avocado, canola, corn, cottonseed, olive, hi-oleic sunflower, mid-oleic sunflower, sunflower, palm stearin, palm kernel olein, safflower, and babassu oils.

The fatty acids may be neutralized with any base to form a soap. Typical bases include, but are not limited to, sodium hydroxide, potassium hydroxide, and triethanolamine. In certain embodiments, the fatty acid soap is formed from fatty acids neutralized by two or more bases. In general, sodium soaps are used in the compositions, but ammonium, potassium, magnesium, calcium or a mixture of these soaps may also be present.

The soap can be made either in situ in amalgamate by mixing a source of fatty acids with the neutralizing agent, or the soap may be provided in a pre-made form. In certain embodiments, the molar amount of fatty acids is greater than the molar amount of neutralizing agent such that fatty acid remains in the amalgamate/pre-made soap. In some embodiments, the fatty acid soap is provided in the composition in the form of soap chips.

In one embodiment, the fatty acid soap can be a blend of 65 to 85 wt. % $C_{16}$-$C_{18}$ fatty acids and 15 to 35 wt. % $C_{12}$-$C_{14}$ fatty acids fatty acids based on the total weight of the soap. In one embodiment, the blend is 80/20. Optionally, $C_{16}$-$C_{18}$ fatty acids can be obtained from tallow, and the $C_{12}$-$C_{14}$ fatty acids can be obtained from lauric, palm kernel, or coconut oils. A typical 80/20 soap contains 65 to 75 weight % sodium soap, 25 to 35 wt. % water, 0.5 to 1.5 wt. % glycerin, 0.5 to 1.5 wt. % sodium chloride, and 0.1 to 0.3 wt. % sodium hydroxide.

In another embodiment, the blend of fatty acids in the fatty acid soap is 85/15. A typical 85/15 soap composition is about 75 to 85 weight % sodium soap, about 10 to 20 weight % water, about 1 to 3 wt. glycerin, and about 0.5 to 1 wt. % sodium chloride. The fatty acids are typically i) 85 wt. % tallow and/or palm stearin fatty acids and ii) 15 wt. % coconut oil or palm kernel oil fatty acids.

In other embodiments, a 95/5, 90/10, 75/25, 65/35 or 60/40 fatty acid blend is used.

Typically, fatty acid soap is incorporated into the amalgamate to achieve a final concentration of from 0.1 weight % to 99 weight % by total weight of the soap bar. In embodiments for a soap bar, the fatty acid soap is incorporated into the amalgamate to achieve a final concentration of from 60 weight % to 90 weight %, 70 weight % to 90 weight %, 70 weight % to 80 weight %, or 75 weight % to 80 weight % by total weight of the soap bar. In embodiments for a combar (which is a mixture of soap and surfactant), there is typically 10 to 20 or 10 to 15 weight % surfactant. For syndet bars, there is typically 0.1 to 15 weight % soap or 7-12 weight % soap.

Optional Ingredients

In some embodiments, one or more further ingredients may be incorporated into the amalgamate. These include, without limitation, structurants, skin conditioning agents, foam boosters, dyes, fragrances, preservatives, chelating agents, antimicrobial agents, and exfoliating/scrubbing particles. In other embodiments, the soap or soap chips may comprise one or more of these optional ingredients. Such ingredients and the amounts in which they could be incorporated into the amalgamate or soap bar would be well known to the person skilled in the art. However, some examples are provided below.

Structurants which may be incorporated into the amalgamate include gellants selected from the group consisting of dibenzylidene sorbitol, dibenzylidene xylitol, dibenzylidene and mixtures thereof. Other examples of structurants include alkali halides and alkali metal sulfates such as sodium chloride and sodium sulfate. Structurants may be incorporated into the amalgamate in an amount of up to 2 weight %.

Skin conditioning ingredients (including emollients) may be included in the compositions. Such ingredients include: various fats and oils (for example, soybean oil, sunflower oil, canola oil, and shea butter; glyceryl esters (for example, PEG 6 caprylic/capric triglycerides, PEG 80 glyceryl cocoate, PEG 40 glyceryl cocoate, PEG 35 soy glyceride); alkyloxylated derivatives of dimethicone (for example, such as PEG/PPG-22/24 Dimethicone and PEG-8 Dimethicone); silicone esters (for example, Dimethicone PEG-7 isostearate); silicone quaternium compounds (for example, Silicone Quaternium-8); lanolin quaternium compounds (For example, quaternium-33); cationic polymers (for example, Polyquaternium-6 and Polyquaternium-7); and silicone polymers (for example, dimethiconol, dimethicone copolyol, alkyl dimethicone copolyol, and dimethicone copolyol amine.

Examples of foam boosters that may be incorporated into the soap bars include certain amphoteric surfactants, cocomonoethanolamide (CMEA), cocoamidopropylamine oxide, cetyl dimethylamine chloride, decylamine oxide, lauryl/myristyl amidopropryl amine oxide, lauramine oxide, alkyldimethyl amine n-oxide, and myristamine oxide. In certain embodiments, the amount of foam booster is 2 weight % to 10 wt. % of the soap bar.

A chelating agent may also be added to the to help retard oxidation. Preferably, EDTA is used as the chelating agent. The chelating agent is preferably present in amounts of about 0.01 wt. % to about 0.2 weight %, or about 0.025 weight % to about 0.1 weight % by total weight of the amalgamate, on an active basis.

The amalgamate may also contain a preservative and/or antimicrobial agent in an amount of up to 1 weight %, or from about 0.01 wt. % to about 0.5 weight %, on an active basis. Examples of preservatives include, but are not limited to, sorbic acid, potassium sorbate, methyl paraben, propyl paraben, imidazolinylurea, methylchloroisothiazolinone, and hydantoins (for example, DMDM hydantoin). Antimicrobial agents include triclocarban, triclosan and the like.

Particulate matter which aids exfoliation may further be incorporated into the soap bar. Particular matter includes polyethylene beads, jojoba beads, lufa, and oat flour.

Fragrance can be incorporated into the amalgamate in an amount of about 0.001 to about 2 wt. % of the composition. The fragrance can include any active agent such as a phenolic, aldehyde, alcohol, nitrite, ether, ketone or ester and the like.

One or more surfactants that would be known to the person skilled in the art may further be provided in the soap or soap chips, or incorporated into the amalgamate. Surfactants include, without limitation, sulfate, sulfonate alpha olefin sulfonates, isethionates (for example, sodium cocoyl isethionate), taurates, sulfosuccinates, phosphates, glycinates, amphoteric surfactants such as betaines, and non-ionic surfactants such as alkanolamides and alkylpolyglucosides.

Water

Water is typically present in the soap bar in an amount of up to about 20 weight %, up to 15 weight %, or up to 10 weight % by total weight of the soap bar. Preferably, water is present in an amount of from 5 weight % to 20 weight %, or from 10 weight % to 20 weight % or from 15 weight % to 20 weight %. Typically, if soap chips are used, they contain water and no exogenous water (other than that associated with any of the other soap bar ingredients) is required to prepare the soap bar.

Preparation of Soap Bar and Uses

The aqueous solution of the taurine or taurine salt is typically combined with the fatty acid soap and optionally, any of the ingredients described herein, in an amalgamator. The term "amalgamation" as used herein refers to a mixing of the solution of the taurine or taurine salt with the soap and any other ingredients, and the term "amalgamate" refers to the mixture formed from amalgamation. Preferably, the soap (for example, in the form of soap chips) is provided at a temperature of 25° C. to 35° C., and preferably, from 27° C. to 32° C., prior to being introduced into the amalgamator or other mixing vessel and being combined with the taurine or taurine salt solution and other ingredients. When the soap temperature exceeds 35° C., the soap billets produced from the plodding/extrusion process (see below) are undesirably soft. Therefore, the temperature of the amalgamate is preferably maintained as defined above. Solid ingredients are typically combined with the soap before the taurine or taurine salt solution and any other liquid ingredients. Exogenous water (i.e. water not associated with any of the ingredients) is generally not added to the amalgamate. Adjustment of drying conditions to retain water in soap chips is more energy efficient and increases the likelihood that the water will be "bound" to the soap, thus providing a firmer soap during processing through the subsequent stages. Typically, once all the ingredients have been combined, two to five minutes of mixing is sufficient to ensure adequate blending of ingredients. However, the duration of mixing may be adjusted according to the formulation, amalgamator size, and if an agitator is used to mix, the speed and design of the agitator.

Once the aqueous solution of the taurine or taurine salt is combined with the fatty acid soap and any of the ingredients described herein, a soap bar may be prepared by conventional manufacturing methods. Typically, the ingredient blend or amalgamate formed as described above is homogenized by passing through a roller mill and/or a refiner. In a roller mill, the gaps between the rollers should be properly set and maintained, if the gaps are too wide, the milling operation is inefficient and the mills serve merely as conveyors of soap. Suitable distances between the rollers may be readily determined by the person skilled in the art of soap manufacture. An efficient cooling water refrigeration and circulation system is also essential for controlling soap temperature. Inadequate cooling of the rollers results in the soap temperature becoming too high which can lead to problems of poor quality in downstream processes and to excessive dropping of the soap from the rollers, with consequent wastage. Typically, the temperature of the water supplied by the refrigeration system is maintained at 10° C. to 15° C. in order to ensure that the temperature of the soap does not exceed about 40° C.

The ingredient blend or amalgamate may additionally be passed through a refiner after milling. The refining stage provides mechanical working and intimate homogenization, and pelletizes the resultant mix for downstream processing. In some embodiments, refining is used as an alternative to roller-milling. In other embodiments, the soap is both refined and milled. Typically in the refining process, 30 to 80 mesh screens provide sufficient refining. Again, as with roller-milling, optimum process control is obtained by providing a cooling water jacket, wherein the water is maintained at 10° C. to 15° C. In a preferred embodiment, the refiner further comprises a pressure plate which comprises tapered holes through which the refined amalgamate passes and is formed into pellets.

A plodding/extrusion operation typically completes compaction of the soap and is used to form billets from the pellets supplied by the milling/refining operations. Plodding/extrusion is generally carried out under vacuum to form air-free billets. An extruded billet core temperature of 37° C. to 43° C. is desirable as in this temperature range, billets tend to be resistant to deformation/scuffing and press well with minimum stress cracking. Single extrusion is also preferred over dual extrusion to maintain bar integrity and wet cracking resistance. The extruded billets may then be cut into the desired length and pressed into a bar shape to form the final soap bar product.

Accordingly, provided is a soap bar obtained by the methods defined herein. The present inventors have found that soap bars obtained by the methods defined herein are resistant to re-crystallization of taurine, even after several weeks of aging. Thus, a smooth surface is maintained and the soap bars are more desirable for application to skin. Thus, another embodiment provides a method for cleansing skin, comprising applying a soap bar obtained by the methods defined herein to skin.

As mentioned above, taurine has many skin care benefits including accelerated healing, and skin repair, particularly after exposure environmental stress. Accordingly, further provided is a use of a soap bar obtained by the methods defined herein for accelerating skin healing and/or skin repair and a method of accelerating skin healing and/or skin repair comprising applying the soap bar to skin.

When in an aqueous solution (e.g. during use), the soap bars typically have a pH of from 7 to 11, optionally 9 to 11, or from 9 to 10.

EXAMPLES

Example 1—Soap Bar Formula with Solid Taurine (1)

In common soap bar manufacturing processes, typically a low level of solid taurine additive is added directly to soap in amalgamate. In this example, and according to the commonly used processes, a soap bar comprising 2% taurine was prepared by mixing taurine powder with soap chips and fragrance in amalgamate. The composition of the final soap bar is provided in Table 1.

TABLE 1

Soap bar composition prepared with taurine powder

| Ingredient | Amount (wt. %) |
|---|---|
| 85/15 Soap | 79.3% |
| Fatty acid | 0.97% |
| Glycerin | 1.24% |
| Sodium chloride | 0.94% |
| Water and minors (fragrance) | Q.S. |
| Taurine | 2% |

To assess the effects of aging, the soap bar produced using the formula of Table 1 was incubated at 40° C. in 75% humidity for four weeks. After aging, it was observed, that the bar had a rough surface with visible crystals. The rough surface/crystals may be attributed to the re-crystallization of taurine during aging.

Example 2—Soap Bar Formula with Solid Taurine (2)

To inhibit the re-crystallization observed in Example 1, a pre-mix comprising taurine powder and fragrance (in a taurine:fragrance weight ratio of 2:1) was prepared. The pre-mix was subsequently combined with soap chips in amalgamate. The formula of the soap bar is indicated in Table 2.

TABLE 2

Soap bar composition prepared with taurine powder/fragrance pre-mix

| Ingredient | Amount (wt. %) |
|---|---|
| 85/15 Soap | 79.3% |
| Fatty acid | 0.97% |
| Glycerin | 1.24% |
| Sodium chloride | 0.94% |
| Water | Q.S. |
| Premix Taurine | 3% |

The soap bar produced was aged as described in Example 1. Again, after aging, it was observed that the bar had a rough surface with visible crystals. The rough surface/crystals may be attributed to the re-crystallization of taurine during aging. Thus, incorporating taurine in the form of a pre-mix with fragrance did not inhibit crystallization.

Example 3—Soap Bar Formula with Taurine Solution

In order to avoid re-crystallization of taurine, a soap bar was prepared by incorporating taurine into the amalgamgate as a solution instead of in powder form. The maximum solubility of taurine in water at room temperature is about 6 weight %. Therefore, if the desired final concentration of taurine in the soap bar is 2 weight %, then this will introduce into the formula approximately 30 weight % water. When wanting lower water content, the taurine solution should not be added in amalgamate, but instead mixed with neat soap. Following addition of the taurine solution to the neat soap, the pre-mixed taurine/neat soap was air-dried to the target moisture level. Subsequently, the taurine-combined chips were mixed with fragrance in amalgamate. The final formula was a specified in Table 1 and aged according to the method described in Example 1.

After aging, it was observed that the soap bar had a smooth surface and taurine re-crystallization had been eliminated successfully.

Example 4—Determining Taurine Salt Solubility

In view of the results of Example 3, attempts were made to find an alternative taurine source which would reduce the re-crystallization of taurine, but which would not introduce large amounts of water into the formulation.

The solubility of taurine salts was therefore investigated to assess whether taurine salt solutions would be an effective taurine source in the soap bar manufacturing process.

Trial 1

1.1. 2.1 g of taurine, 1.3 g of 50% Sodium hydroxide solution and 2.7 g DI water were admixed in a beaker with stirring bar (weight of beaker and stirring bar=25.3 g);

1.2. On mixing, a clear solution was quickly formed indicating that the solid (i.e. taurine salt) was completely dissolved.

$$\text{Concentration of taurine (\%) ([taurine])}=2.1/(2.1+1.3+2.7)\times 100=34.2\%;$$

1.3. The above solution was mixed and heated to evaporate water. The total weight of beaker was reduced to 28.9 g and a clear solution remained.

$$[\text{taurine}]=2.1/(28.9-25.3)\times 100=58.6\%;$$

1.4 The above solution was mixed at room temperature for 3 hours. The total weight of the beaker and solution was reduced to 28.9 g and a clear solution remained.

[taurine]=2.1/(28.9−25.3)×100%=59.2%;

1.5. The above solution was mixed at room temperature overnight. Solid taurine salt was visible and the weight of the beaker with the contents had been reduced to 28.5 g.

[taurine]=2.1/(28.5−25.3)×10=66.4%.

It could be concluded that on conversion to a taurine salt (sodium taurine), the solubility of taurine was increased to a value between 59.2% and 66.4%. The corresponding taurine salt solubility was between 69.6% and 78.1% (Mw of taurine=125; Mw of taurine salt=147).

Trial 2

2.1. 3.1 g of taurine, 2 g of 50% Sodium hydroxide solution and 1.1 g of DI water were combined in a beaker with a stirring bar (weight of beaker and stirring bar=28.2 g);

2.2. The contents were mixed and a clear solution formed quickly indicating that the solid (taurine salt) had dissolved completely.

Concentration of taurine (%) ([taurine])=3.1/(3.1+2+1.1)×100=50.3%;

2.3. The above solution was mixed at room temperature overnight. A clear solution was maintained and the total weight of beaker (with contents) had been reduced to 33.5 g

[taurine]=3.1/(33.5−28.2)×100=57.2%;

2.4. The above solution continually was mixed at room temperature overnight. The total weight of the beaker with contents had been reduced to 33.5 g, and a clear solution was maintained.

[taurine]=3.1/(33.5−28.2)×100=57.2%;

2.5. The above solution continually was mixed at room temperature overnight. The total weight of the beaker with contents had been reduced to 33 g, but some solids were observed

[taurine]=3.1/(33−28.2)×100=64%.

It could be concluded that on conversion to a taurine salt (sodium taurine), the solubility of taurine was increased to a value between 57.2% and 64%. The corresponding taurine salt solubility was between 67.3% and 75.2% (Mw of Taurine=125; Mw of Taurine salt=147).

The above results indicated that incorporation of taurine into a soap bar amalgamate as a taurine salt solution was feasible, and that no additional step of water removal would be required to manufacture the soap bar.

Example 4—Soap Bar Formula with Taurine Salt Solution

Taurine, 50% Sodium hydroxide solution and DI water were mixed in a weight ratio of 50:32:18. The mixture quickly turned to clear solution. Four parts of above solution were admixed with 95 parts of soap chips and 1 part of fragrance to form an amalgamate. A soap bar was prepared from the amalgamate. The formula of the prepared soap bar is indicated in Table 3.

TABLE 3

Soap bar composition prepared with taurine powder/fragrance pre-mix

| Ingredient | Amount (wt. %) |
|---|---|
| 85/15 Soap | 77.7% |
| Fatty acid | 0.95% |
| Glycerin | 1.2% |
| Sodium chloride | 0.92% |
| Water | Q.S. |
| Fragrance | 1% |
| Taurine* | 2% |

*The term "taurine" represents the taurine moiety of the taurine salt (sodium taurine) and does not include the sodium cation.

The soap bar prepared using the above formula was aged as described in Example 1. After aging, there were no visible crystals and the soap bar had a smooth surface. These results indicated that re-crystallization of taurine can be eliminated by incorporating taurine as a salt solution in amalgamate.

Example 5—pH of Soap Bar with Taurine

Typically the pH of soap bar formulae is between 7 and 11. Adding a low level of taurine in a soap bar formula should not significantly change the pH of the soap bar product. (The pK1 value of the sulfonic acid group of taurine is 1.52 and the pK2 value of the amino group of taurine is 8.74). Furthermore, when the soap bar is used by the consumer (in the presence of water), any taurine will be converted into a salt form. Therefore, the performance of the soap bar should not be affected by incorporating taurine as a taurine salt solution.

The pH of soap solutions formulated with taurine as a solid additive was compared to the pH of soap solutions formulated with a taurine salt solution. The results are indicated in Table 4.

TABLE 4 pH of soap solutions

| Formula | pH |
|---|---|
| Control bar without Taurine | 10.4 |
| Soap bar with 2% Taurine (solid additive) | 9.9 |
| Soap bar with 2% Taurine (salt solution) | 10.2 |

As can be seen from Table 4, the pH of soap bars formulated with both taurine and taurine salt solutions falls within the desirable range of 7 to 11.

The invention claimed is:

1. A method for reducing or inhibiting the crystallization of taurine in a soap bar, wherein the method comprises:

a) admixing a fatty acid soap with an aqueous solution of taurine or a taurine salt as a taurine source to form an amalgamate and, b) preparing a soap bar comprising the amalgamate; wherein the taurine is represented by Formula 1:

Formula 1

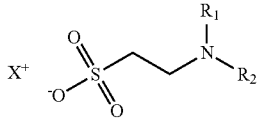

wherein X is a cation selected from hydrogen, an alkali metal cation, ammonium and triethanolammonium, and wherein $R_1$ and $R_2$ are independently selected from H and a $C_1$-$C_4$ alkyl, and wherein a pH of the soap bar, in aqueous solution, is from 9 to 11.

2. The method of claim 1, wherein $R_1$ and $R_2$ are H.

3. The method of claim 1, wherein X is an alkali metal cation selected from sodium and potassium.

4. The method of claim 1, wherein the soap bar does not comprise any taurine source other than the aqueous solution of the taurine or taurine salt.

5. The method of claim 1, wherein the aqueous taurine or taurine salt solution comprises taurine or taurine salt in an amount of 40 to 60 weight %.

6. The method of claim 1, wherein the soap bar comprises taurine or taurine salt as defined in Formula 1, in an amount of 0.1 to 5 weight % by total weight of the soap bar.

7. The method of claim 6, wherein the soap bar comprises taurine or taurine salt in an amount of 1 to 3 weight % by total weight of the soap bar.

8. The method of claim 1, wherein the fatty acid soap is admixed with the aqueous solution of taurine or a taurine salt at a temperature of 25° C. to 35° C.

9. The method of claim 1, wherein the aqueous solution of the taurine or taurine salt is further admixed with fragrance to form the amalgamate.

10. A soap bar obtained by the method of claim 1.

11. A method for cleansing skin, comprising applying the soap bar of claim 10 to skin.

12. A method for manufacturing a soap bar, comprising:

a) combining a fatty acid soap with the aqueous solution of taurine or a taurine salt to form an amalgamate and, b) preparing a soap bar comprising the amalgamate;

wherein the taurine or taurine salt is represented by Formula 1:

Formula 1

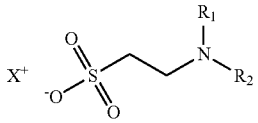

wherein X is a cation selected from hydrogen, an alkali metal, ammonium and triethanolammonium, and wherein $R_1$ and $R_2$ are independently selected from H and a $C_1$-$C_4$ alkyl, wherein the aqueous solution of the taurine or taurine salt is prepared by admixing an alkali metal hydroxide solution, taurine or taurine salt, and water, wherein the alkali metal is selected from sodium and potassium, and wherein a pH of the soap bar, in aqueous solution, is from 9 to 11.

13. The method of claim 12, wherein $R_1$ and $R_2$ are H.

14. The method of claim 12, wherein X is potassium.

15. The method of claim 12, wherein the soap bar does not comprise any taurine source other than the aqueous solution of the taurine or taurine salt.

16. The method of claim 12, wherein the aqueous taurine or taurine salt solution comprises taurine or taurine in an amount of 40 to 60 weight %.

17. The method of claim 12, wherein the soap bar comprises taurine or taurine salt in an amount of 0.1 to 5 weight % by total weight of the soap bar.

18. The method of claim 17, wherein the soap bar comprises taurine or taurine salt in an amount of 1 to 3 weight % by total weight of the soap bar.

19. The method of claim 12, wherein the fatty acid soap is admixed with the aqueous solution of taurine salt or a taurine salt at a temperature of 25° C. to 35° C.

20. The method of claim 12, wherein the aqueous solution of the taurine or taurine salt is further admixed with fragrance to form the amalgamate.

21. The method of claim 12, wherein X is sodium.

* * * * *